United States Patent [19]

Moranne

[11] 4,231,422

[45] Nov. 4, 1980

[54] METHOD FOR PROTECTING HEAT EXCHANGER TUBES MADE OF ALUMINUM AGAINST EROSION AND/OR CORROSION

[75] Inventor: Jean-Pierre Moranne, Franconville, France

[73] Assignee: Societe Anonyme des Usines Chausson, Asnieres, France

[21] Appl. No.: 76,986

[22] Filed: Sep. 20, 1979

Related U.S. Application Data

[63] Continuation of Ser. No. 899,155, Apr. 24, 1978, abandoned.

[30] Foreign Application Priority Data

May 6, 1977 [FR] France ..... 77 13968

[51] Int. Cl.[3] ..... F28F 19/06; F28F 9/06

[52] U.S. Cl. ..... 165/69; 165/109 T; 165/133; 165/134 R; 165/178; 165/180

[58] Field of Search ..... 165/69, 178, 173, 175, 165/133, 134, 180, 109 T

[56] References Cited

U.S. PATENT DOCUMENTS

| | | | |
|---|---|---|---|
| 2,303,416 | 12/1942 | Woods | 165/178 |
| 2,816,739 | 12/1957 | Stoehr | 165/178 |
| 3,332,479 | 7/1967 | Martin, Jr. | 165/178 |
| 3,583,478 | 6/1971 | Fieni | 165/69 |
| 3,878,871 | 4/1975 | Anthony et al. | 165/180 |
| 3,960,208 | 6/1976 | Anthony et al. | 165/180 |

*Primary Examiner*—Sheldon Richter
*Attorney, Agent, or Firm*—Browdy and Neimark

[57] ABSTRACT

To prevent the erosion caused by cavitation phenomena between a turbulence member and a tube of a tubular heat exchanger, as well as the corrosion by differential aeration in thin intervals between the tube of aluminum containing alloy and an elastomeric gasket, aluminum silicon platings are provided on the two walls of the tube.

4 Claims, 1 Drawing Figure

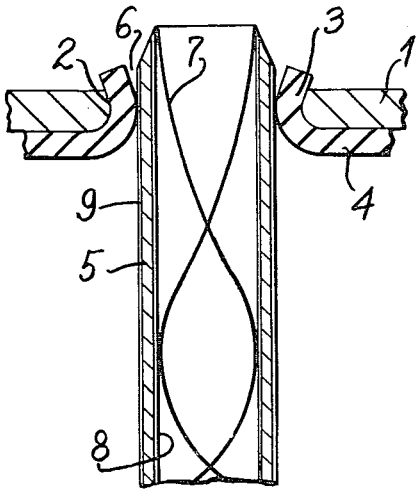
6
3
2
7
1
4
9
5
8

METHOD FOR PROTECTING HEAT EXCHANGER TUBES MADE OF ALUMINUM AGAINST EROSION AND/OR CORROSION

This is a continuation of application Ser. No. 899,155, filed Apr. 24, 1978 now abandoned.

The present invention relates to heat exchangers of the type of cooling or heating exchangers which comprise tubes made of aluminum connected to one or more tube plates by resilient elastomeric gaskets which form tightening sockets.

The invention relates still more particularly to those of the heat exchangers which comprise turbulence members within the tubes of the heat exchangers.

It has been found that for improving the technical efficiency of these heat exchangers, particularly when the tubes are of a circular cross-section, the liquid circulating is caused to flow at relatively high speeds. It results from these high speeds that cavitation phenomenon can occur within the tubes, particularly when these tubes contain turbulence members, which phenomenon has for its effect the generation if so-called erosion-cavitation which is quite similar to corrosion in result since this phenomenon can produce a quick perforation of the tubes.

The water tightness between the tube plate and each of the tubes being provided by a resilient gasket, and the tube as well as the gasket protruding from the tube plate on a length of some millimeters, the portion of the gasket protruding from the tube plate is not tightened by the tube plate. It results therefrom that some liquid can penetrate between the gasket and the outer wall of the tube, which causes corrosion by differential aerating.

The present invention copes with the above mentioned drawbacks and eliminates practically the so-called corrosion-cavitation effects as well as the corrosion effects due to differential aeration.

According to the invention, the heat exchanger comprises tubes made of an aluminum containing alloy, a perforated tube plate foming tube passages in which are mounted the tubes, elastomeric tightness sockets inserted between said tubes and said tube passages, said tubes having an inner surface and an outer surface with at least one of the inner surface and the outer surface being coated with a layer of aluminum-silicon alloy containing from 5 to 12% silicon. Various other features of the invention are moreover revealed from the following detailed disclosure.

An embodiment of the object of the invention is shown as a non-limitative example in the accompanying FIGURE of the drawing which is a diagrammatical cross-section of a tube, tube plate and tightening gasket assembly embodying the present invention.

In the drawing, reference numeral 1 designates the tube plate of a heat exchanger, typically a cooling or heating radiator. The tube plate 1 has, in a manner known per se, tube passages 2 in each one of which is engaged a socket 3 made of a distortable resilient gasket 4, for example of elastomeric material.

Reference numeral 5 designates a heat exchanger member such as a tube which, preferably, is of a circular cross-section whereas other shapes can be used without departing from the scope of the invention. The tube 5 is forced into the corresponding socket 3 which is thus tightened in the tube opening 2 of the end plate while providing a suitable tightness between the outer wall of the tube 5 and the tube plate.

As shown in the drawing, the upper portion of the socket 3 which protrudes beyond the tube plate is obviously not tightened and it results therefrom that this portion is not very firmly applied onto the outer wall of the tube 5, which generates beginning of a recess 6 all around the tube 5.

The tube 5 is insidely provided, also in a manner known per se, with a turbulence member 7 constraining the liquid to follow a more or less laminar path at a high speed able to give rise to cavitation phenomena.

In order to reduce and even cancel the erosion of the tube 5 by the cavitation phenomena which may occur due to the flowing speed of the liquid, the tube 5 is made of an aluminium containing alloy and preferably of aluminium and the inner wall of the tube is coated with a layer 8 which is preferably an aluminium-silicon plating containing from 5 to 12% silicon and having a thickness within the range of 5 to 10% of the thickness of the wall of the tube 5.

In a similar manner, for reducing and even cancelling the corrosion risks caused by a differential aeration of the tube 5 at the recess 6 and then progressively between its outer surface and the tightening portion of the socket 3, the outer wall of said tube 5 is coated with a layer 9 which is preferably made as the layer 8 of an aluminium-silicon plating containing from 5 to 12% silicon and having a thickness within the range of 5 to 10% of the thickness of the wall of said tube 5.

The invention is not restricted to the embodiment shown and described in detail since various modifications thereof may be applied thereto without departing from the scope of the invention as shown in the appendant claims.

I claim:

1. Heat exchanger comprising tubes made of an aluminum containing alloy, a perforated tube plate forming tube passages in which are mounted the tubes, elastomeric tightness sockets inserted between said tubes and said tube passages, said tubes having an inner surface and an outer surface with at least one of the inner surface and outer surface being coated with a layer of aluminum-silicon alloy containing from 5 to 12% silicon.

2. Heat exchanger as set forth in claim 1, wherein both the inner surface and the outer surface of the tubes are coated with a layer of aluminum-silicon alloy containing from 5 to 20% silicon.

3. Heat exchanger as set forth in claim 1, wherein the protecting layer has a thickness comprised between 5 and 10% of the thickness of the members which are coated.

4. Heat exchanger as set forth in claim 1, wherein an inner turbulence member is mounted in each of the tubes.

* * * * *